US006485279B2

(12) United States Patent
Zhong et al.

(10) Patent No.: US 6,485,279 B2
(45) Date of Patent: Nov. 26, 2002

(54) THRUST LOAD RELIEVER

(75) Inventors: Jianping Zhong, Michigan City, IN (US); Joost J. Brasz, Fayetteville, NY (US); John J. Jacobs, Pulaski, NY (US); Frederick L. Miller, Jr., Syracuse, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/747,134

(22) Filed: Dec. 26, 2000

(65) Prior Publication Data

US 2002/0081226 A1 Jun. 27, 2002

(51) Int. Cl.[7] ..... F03C 2/00

(52) U.S. Cl. ..... 418/141; 418/77; 418/142; 418/144; 418/203

(58) Field of Search ..... 418/141, 203, 418/142, 144, 77

(56) References Cited

U.S. PATENT DOCUMENTS

| | | | | | |
|---|---|---|---|---|---|
| 3,275,226 | A | * | 9/1966 | Whitfield | 418/203 |
| 3,736,079 | A | * | 5/1973 | Kantz | 418/77 |
| 6,050,797 | A | * | 4/2000 | Zhong | 418/203 |
| 6,093,007 | A | * | 7/2000 | Shaw | 418/203 |
| 6,186,758 | B1 | * | 2/2001 | Shaw | 418/203 |

FOREIGN PATENT DOCUMENTS

| | | | | |
|---|---|---|---|---|
| GB | 1301475 | * | 12/1972 | 418/203 |
| JP | 53-112509 | * | 10/1978 | 418/203 |
| JP | 06-101672 | * | 4/1994 | 418/203 |

* cited by examiner

*Primary Examiner*—Thomas Denion
*Assistant Examiner*—Theresa Trieu

(57) ABSTRACT

The area of the discharge end of a screw rotor acted on by the discharge pressure is reduced by locating a region of suction pressure acting on the discharge end of the rotor and separating the suction and discharge pressures by a labyrinth seal located between the discharge end of the rotor and the facing housing structure.

19 Claims, 8 Drawing Sheets

FIG.2

THRUST LOAD RELIEVER

BACKGROUND OF THE INVENTION

In screw machines such as refrigerant compressors, the refrigerant being compressed tends to move the screw rotors towards the suction side and away from the discharge side. In the case of tri-rotor compressors the sun rotor has a much larger diameter than the other rotors and this equates to a much larger area to be acted on by the discharge pressure. In the case of a tri-rotor, the sun rotor has about 150° of compression with each of the coacting rotors and about 30° of overlap with each coacting rotor. Suction and discharge pressure are separated at the discharge end face of the sun rotor by a distance corresponding to the extremes of the overlap distance. Accordingly, discharge pressure does not act over the entire discharge end face of the sun rotor and suction pressure can act over part of the discharge end face of the sun rotor with a relatively short distance between discharge and suction pressure. In addition to the thrust loading produced by the discharge pressure acting on the ends of the rotors, the separation of the rotors from the discharge side represents a leak passage. The discharge side bearings and related structure tend to severely limit movement of the rotors away from the discharge and thereby limit leakage. Commonly assigned U.S. Pat. No. 5,975,867 discloses structure associated with the discharge side bearings for limiting axial movement of the screw rotors. The suction side bearings are much less loaded due to the movement restraint applied to the rotors by the discharge side bearings and their related structure. U.S. Pat. No. 5,911,743 discloses balancing the pressure on the ends of the rotors to limit thrust loading of the bearings. This approach requires radial porting with a reduction in port area and efficiency as well as additional parts.

SUMMARY OF THE INVENTION

Pressure balancing on the ends of a screw rotor is achieved by locating a fluid pressure chamber at the discharge end of the screw rotor and exposing the chamber to suction pressure. The fluid pressure chamber is sealed from the discharge pressure acting on the outer portions of the discharge end of the screw rotor by a labyrinth seal located between the discharge end of the rotor and the facing housing structure. In addition to providing a fluid seal, the labyrinth reduces leakage between the discharge end of the rotor and the housing. The labyrinth seal and the fluid pressure chamber are both located between the rotor profile root diameter and the shaft diameter. The actual design of the labyrinth and fluid pressure chamber is a compromise of a number of mutually exclusive goals. The actual screw machine dictates some dimensional limits upon which the following goals are superimposed: (1) a desire to have as much labyrinth seal as possible; (2) a desire to have the outer diameter of the labyrinth seal as large as possible; (3) the desire to have the inner diameter of the labyrinth seal as large as possible; (4) the desire to have a greater port area than is available when a thrust disk is employed; and (5) the desire to have a simpler design than that of a thrust disk.

It is an object of this invention to reduce thrust loading on a sun rotor of a multi-rotor screw compressor.

It is an additional object of this invention to provide pressure balancing while employing axial porting.

It is another object of this invention to reduce leakage at the discharge end of a screw rotor. These objects, and others as will become apparent hereinafter. are accomplished by the present invention.

Basically, the area of the discharge end of a screw rotor acted on by the discharge pressure is reduced by providing a region of suction pressure which acts on the discharge end of the rotor and separating the suction and discharge pressures by a labyrinth seal located between the discharge end of the rotor and the facing housing structure.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
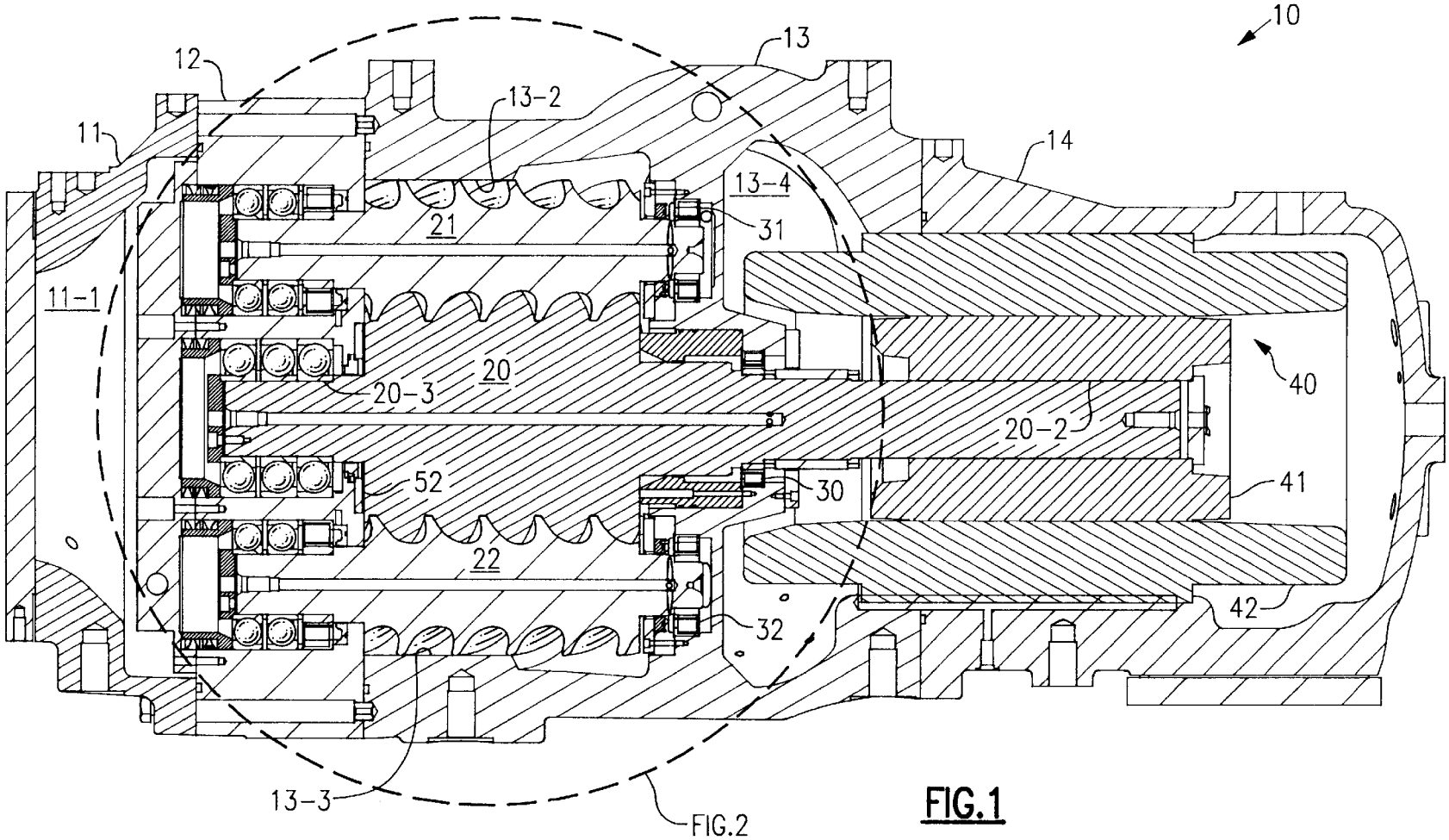
FIG. 1 is a sectional view of a first embodiment of the present invention.
Figure 2:
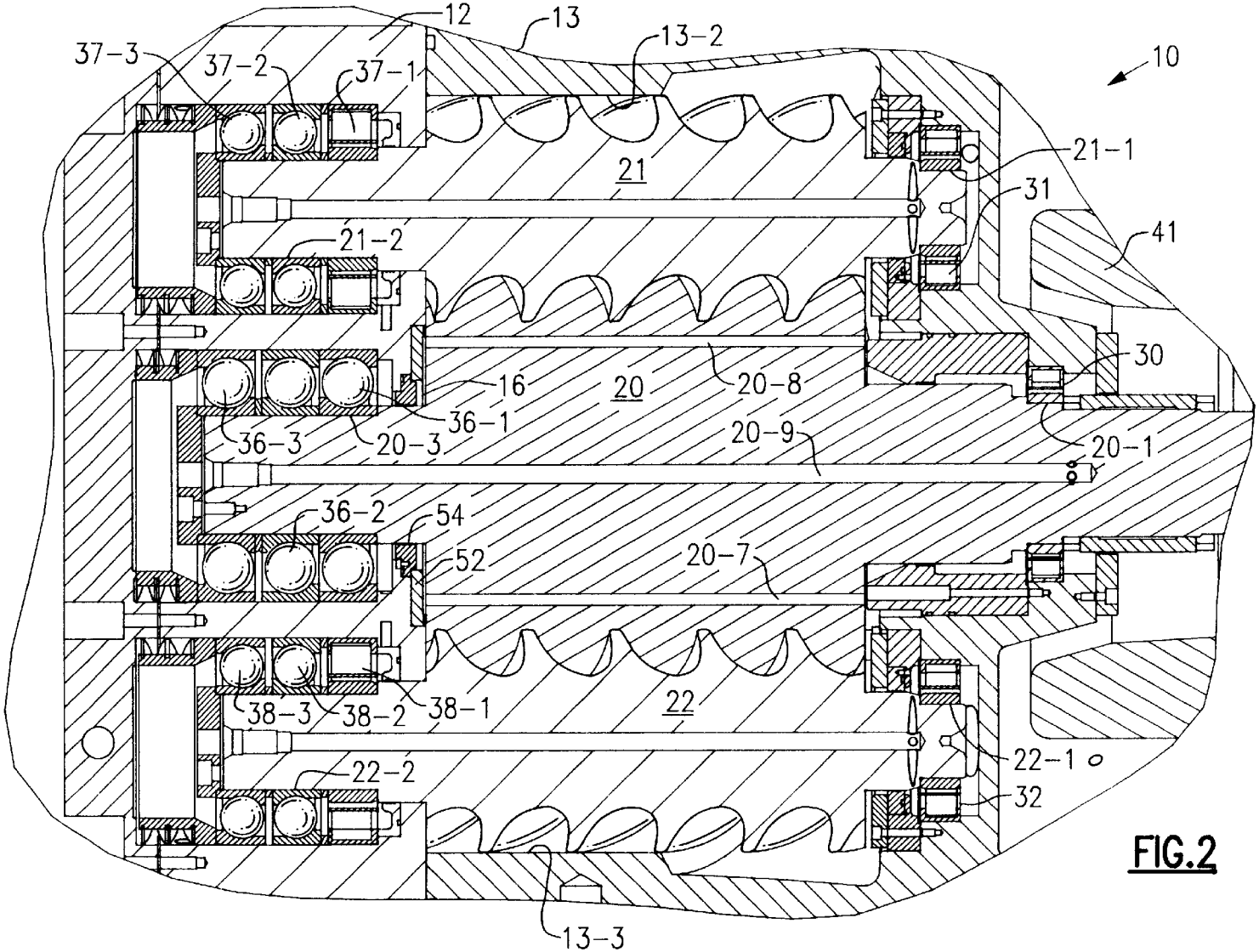
FIG. 2 is an enlarged view of a portion of FIG. 1.
Figure 3:
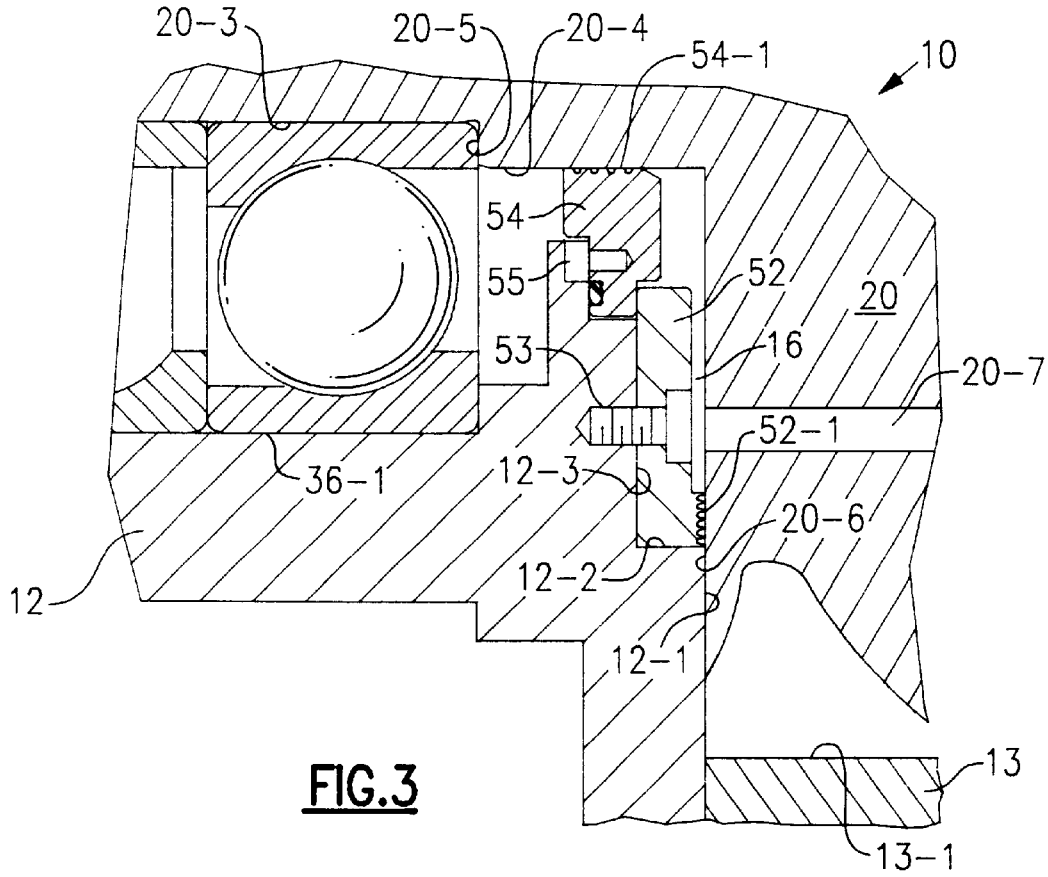
FIG. 3 is a further enlarged and slightly rotated view of a portion of FIG. 2.

In FIGS. 1 through 3, the numeral 10 generally indicates a multi-rotor screw machine, such as a refrigeration compressor, with a tri-rotor device being illustrated. Compressor 10 serially has a discharge cover 11, outlet casing 12, rotor housing 13 and motor housing 14 which are suitably secured together to form a semi-hermetic unit. Within rotor housing 13 are male rotor 20 and female rotors 21 and 22 which are located in bores 13-1, 13-2 and 13-3 for rotors 20, 21 and 22, respectively. Male, or sun, rotor 20 has a shaft portion 20-1 which is received in and supported by inlet bearing 30 and a reduced shaft portion 20-2 to which motor rotor 41 of electric motor 40 is shrunk fit, as illustrated, attached with a key and slot or otherwise suitably secured. Stator 42 of motor 40 is suitably received in motor housing 14. Male rotor 20 is driven by electric motor 40 and, in turn, drives female rotors 21 and 22, respectively. Rotors 21 and 22 have shaft portions 21-1 and 22-1, respectively which are received in and supported by inlet bearings 31 and 32, respectively. Inlet bearings 30, 31 and 32 are roller bearings which support the radial loads created by the compression cycle on rotors 20, 21 and 22, respectively.

Male rotor 20 has a discharge end shaft portion 20-3 which is received in and supported by a plurality of discharge bearings 36-1, 36-2 and 36-3, respectively. Female rotor 21 has a discharge end shaft portion 21-2 which is received in and supported by a plurality of discharge bearings 37-1, 37-2 and 37-3, respectively. Similarly, female rotor 22 has a discharge end shaft portion 22-2 which is received in and supported by a plurality of discharge bearings 38-1, 38-2 and 38-3, respectively. Discharge bearings 36-1 to -3, 37-1 to -3 and 38-1 to -3 are received in and supported by outlet casing 12 which defines flow paths (not illustrated) between the discharge of coacting pairs of rotors and the compressor discharge chamber 11-1 formed in discharge cover 11.

Ignoring leakage, the only fluid communication between suction chamber 13-4 and discharge chamber 11-1 is through coacting pairs of rotors. Specifically, as illustrated, male, sun rotor 20 is driven by motor 40 and coacts with rotors 21 and 22 to continuously define volumes therebetween which serially expand while being exposed to suction chamber 13-4, are sealed off and reduced in volume thereby compressing the trapped volumes of gas, the compressed trapped volumes are exposed to discharge chamber 11-1, and the exposed volumes are reduced in volume so that the contents of each trapped volume is delivered to discharge chamber 11-1. Because the rotors must run with a clearance and with axial porting putting discharge gas at the clearance, discharge pressure tends to act on portions of the discharge end of the rotors. Since only suction pressure acts on the inlet end of the rotors there is an axial thrust loading on the rotors towards suction. As noted above, male sun rotor 20 having the largest diameter has the largest area that can be acted on by discharge pressure and thereby the largest thrust loading potential.

The present invention reduces the thrust loading on the male, sun rotor 20 by locating an annular pressure chamber at the discharge end of the sun rotor 20 and by maintaining suction pressure in the pressure chamber. The discharge pressure acting on the outer portion of sun rotor 20 is sealed from the pressure chamber at suction pressure by a labyrinth seal located in the clearance between sun rotor 20 and outlet casing 12. The labyrinth can be formed as a separate piece and seal with either the rotor 20 or outlet casing 12. Alternatively, the labyrinth may be formed in the discharge end of the male rotor 20 or in the facing surface 12-1 of outlet casing 12.

To form the annular suction pressure chamber 16 at the discharge end of male rotor 20, a shaft portion 20-4 is provided on rotor 20, as is best shown in FIG. 3. Shaft portion 20-4 is of a greater diameter than shaft portion 20-3. Shaft portion 20-4 extends axially from an axial location corresponding to the running clearance 50 defining the interface of discharge end face 20-6 of rotor 20 and facing surface 12-1 of outlet casing 12 to shaft portion 20-3 with which it is connected through shoulder 205.

Figure 3A:
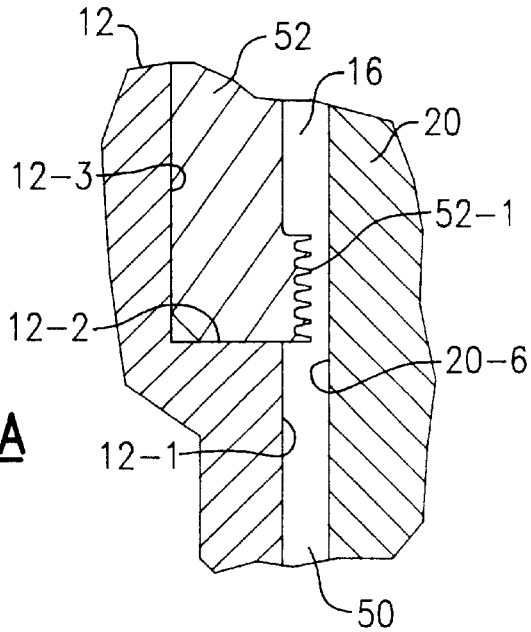
FIG. 3A is a further enlargement of a portion of FIG. 3.
Figure 4:
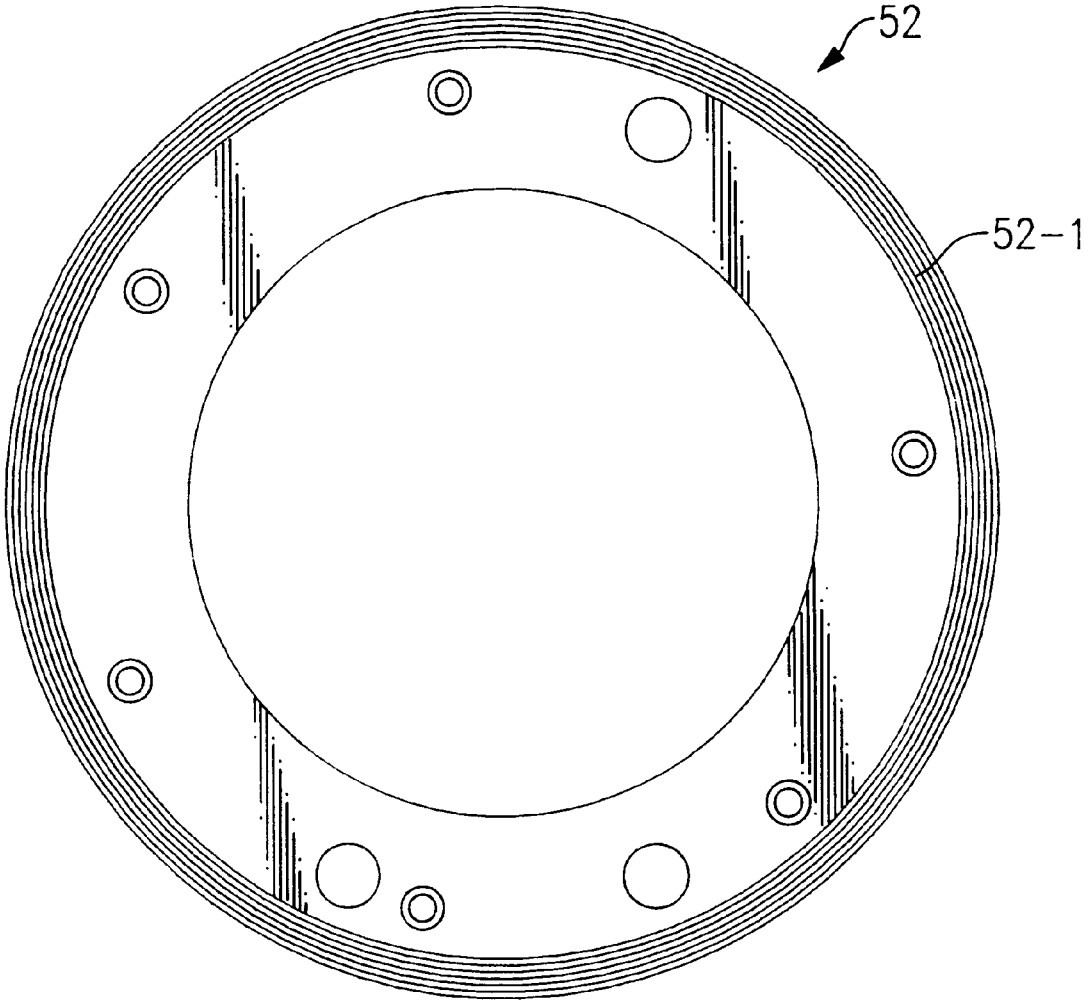
FIG. 4 is an end view of the axial seal.

The discharge end face 20-6 of rotor 20 is separated from facing surface 12-1 of outlet casing 12 by clearance 50, as best shown in FIG. 3A. Bore 12-2 is coaxial with bore 13-1 of rotor 20 and is of such a diameter as to fall just radially inward of the rotor profile root diameter of rotor 20. Bore 12-2 terminates at annular shoulder 12-3. Annular axial seal 52, which is best shown in FIG. 4, has an axially extending labyrinth seal 52-1 defined by a plurality of radially spaced alternating concentric grooves and ridges on the outer portion of annular axial seal 52. Alternatively, the seal may be made up of circumferentially spaced arc segments rather than complete circles. The arc segments would be staggered radially. Annular axial seal 52 is received in and secured in bore 12-2 by screws 53 such that it is supported by shoulder 12-3. Labyrinth seal 52-1 is radially inward of clearance 50, as best shown in FIG. 3A, and in a narrowly spaced facing relationship with discharge end face 20-6. Labyrinth seal 52-1 provides a greater flow restriction and thereby a seal between discharge pressure radially outward of labyrinth seal 52-1 and annular suction pressure chamber 16 located radially inward of the labyrinth seal 52-1. Annular axial seal 52 engages and axially secures floating radial seal 54. Radial seal 54 is prevented from rotating with rotor 20 by anti-rotation pin 55. Radial seal 54 has a labyrinth seal 54-1 which surrounds and seals with rotor shaft portion 20-4 and thereby coacts with labyrinth seal 52-1 in sealing annular suction pressure chamber 16 from discharge pressure. Annular suction pressure chamber 16 is in fluid communication with the suction chamber 13-4 via axially extending bores 20-7 and 20-8 which are diametrically spaced relative to axial bore 20-9.

In operation, suction pressure in suction chamber 13-4 and in annular suction pressure chamber 16 acting on opposite ends of rotor 20 reduces the unbalance thrust forces to acceptable levels although the areas acted upon are not equal. Discharge pressure acting on rotor discharge end face 20-6 radially outward of labyrinth seal 52-1 provides a thrust load on rotor 20 tending to separate rotor discharge end face 20-6 and surface 12-1 to increase the cross section of clearance 50 and the spacing between labyrinth 52-1 and end face 20-6, both of which are part of the leak passage of discharge pressure to chamber 16. Intermediate pressure from the leaking fluid acting on labyrinth 52-1 will also provide a thrust load on the rotor 20. The cross section of clearance 50 and the spacing between labyrinth 52-1 and surface 20-6 is controlled by bearing constraints provided by discharge bearings 36-1, 36-2 and 36-3. Additionally, by placing labyrinth 52-1 radially outward as far as possible, the area acted on by the discharge pressure is minimized.

Figure 5:
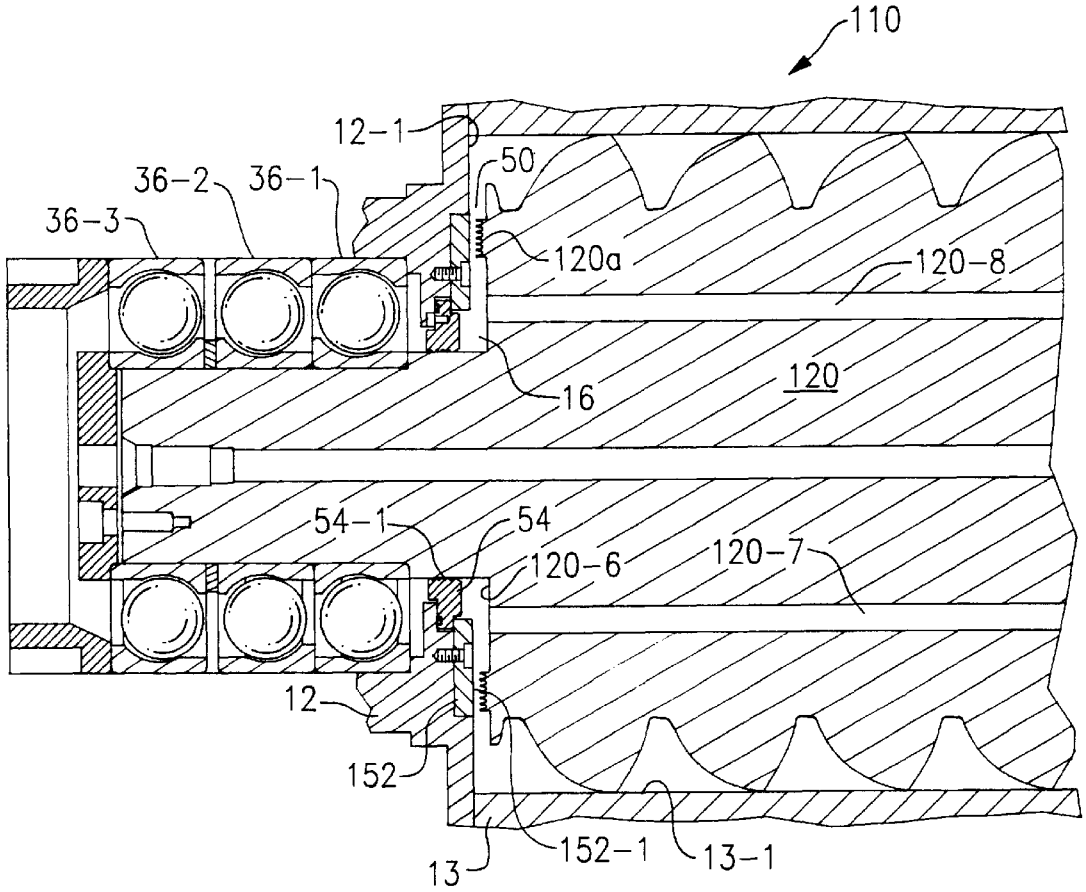
FIG. 5 is a sectional view of a second embodiment of the present invention.

The embodiment of FIG. 5 differs from that of FIGS. 1–4 in two respects. First, the labyrinth seal **120-*a* is integral with rotor 120 and is located on the discharge end 120-6 of rotor 120 which is in bore 13-1. Second, the axial seal 52 has been modified to retainer 152 such that it provides a facing surface 152-1 which coacts with labyrinth seal 120-*a* in a manner comparable to the coaction between discharge end face 20-6 and labyrinth seal 52-1. Retainer 152 engages and axially secures floating radial seal 54 in the same manner as axial seal 52. Being integral with the rotor 120, labyrinth seal 120-*a* rotates therewith. Otherwise, screw machine 110 is the same in structure and operation as screw machine 10 and only modified structure has been numbered one hundred higher in FIG. 5 than in FIGS. 1–4**.

Figure 6:
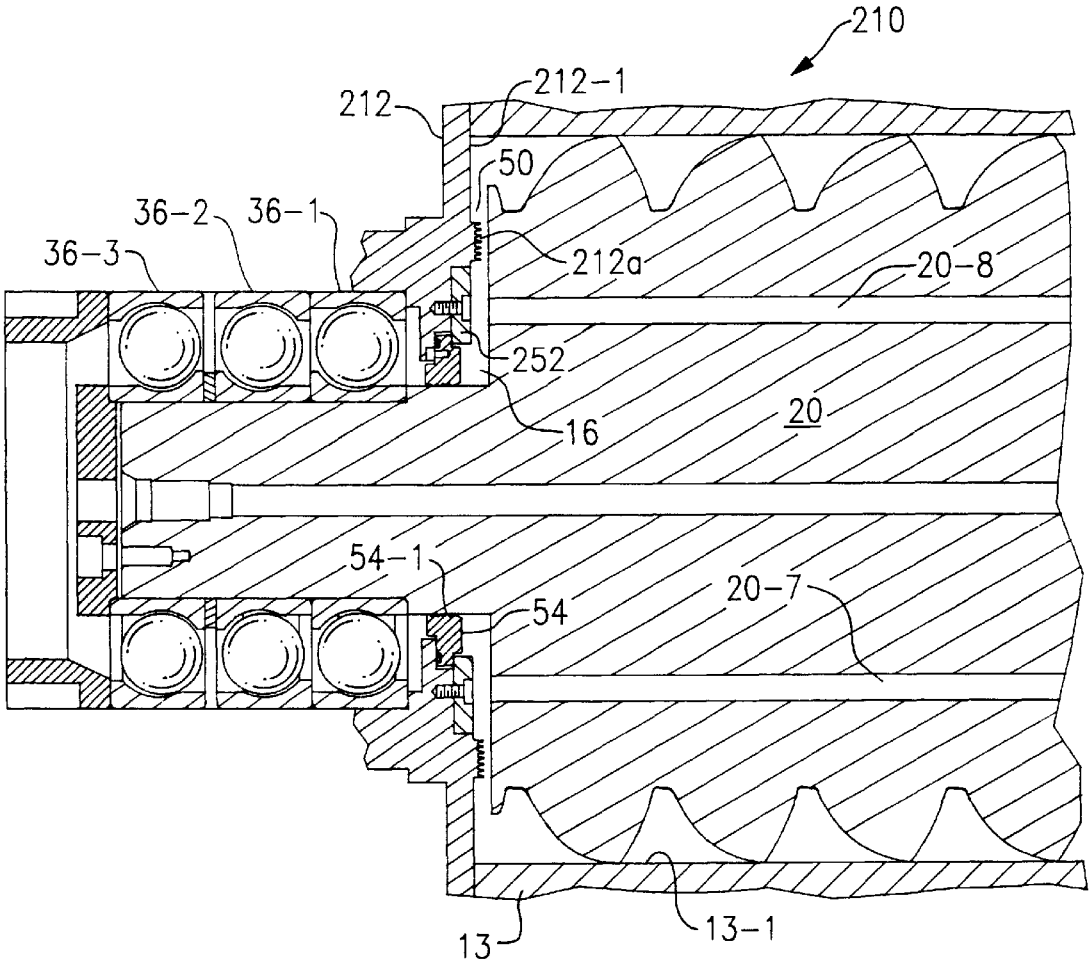
FIG. 6 is a sectional view of a third embodiment of the present invention.

The embodiment of FIG. 6 differs from the embodiment of FIG. 5 in that the labyrinth seal **212-*a* is formed in discharge housing surface 212-1 of outlet casing 212. Retainer 252 solely serves to engage and axially secure floating radial seal 54 in the same manner as axial seal 52. Otherwise screw machine 210 is the same in structure and operation as screw machine 110** and only modified structure has been numbered in the two hundred series.

Figure 7:
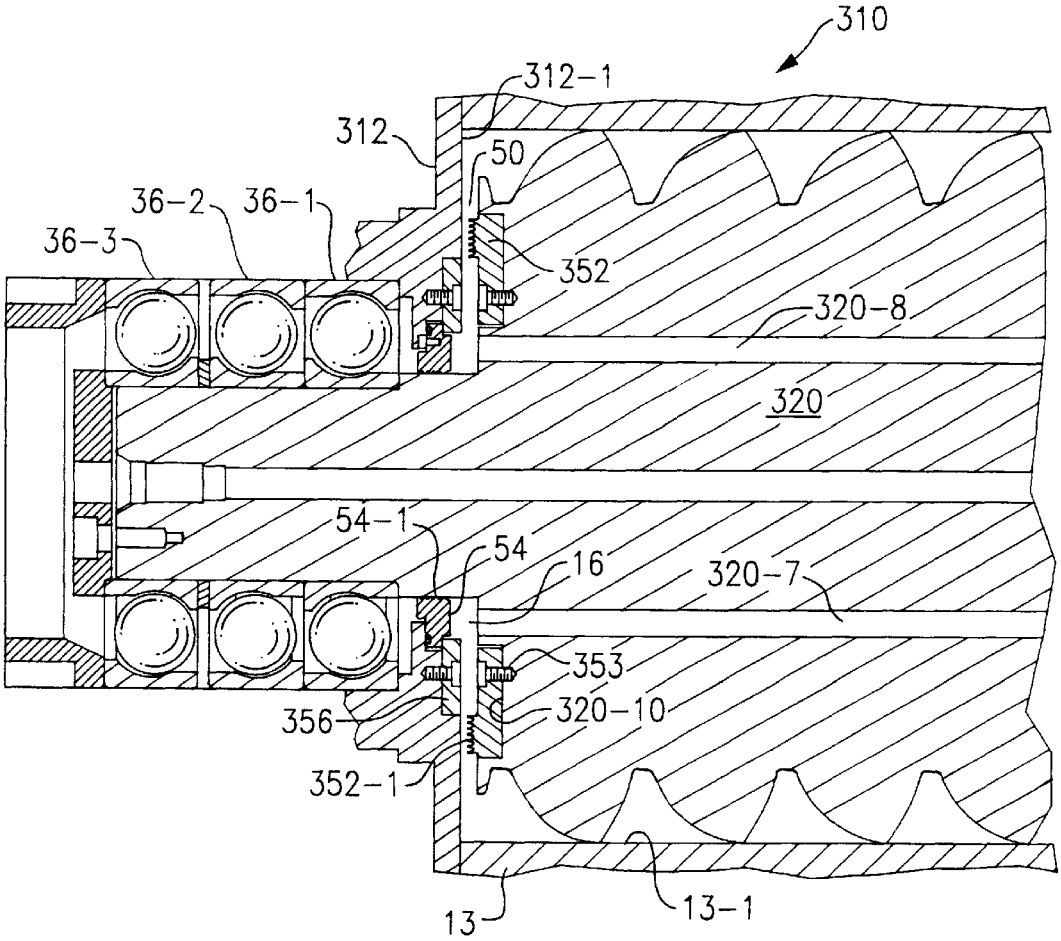
FIG. 7 is a sectional view of a fourth embodiment of the present invention.

The embodiment of FIG. 7 differs from that of FIG. 5 in that the axial seal 352 is a separate member rather than integral with rotor 320. Axial seal 352 includes labyrinth 352-1 and is received in an annular recess 320-10 located on rotor 320 rather than on the outlet casing 312, as in the embodiment of FIGS. 1–3, and is held in place by screw 353. Labyrinth 352-1 faces and seals with facing surface 312-1. Retainer 356 solely serves to engage and axially secure floating radial seal 54 in the same manner as axial seal 52. Otherwise screw machine 310 is the same in structure and operation as screw machine 10. All new and modified structure has been numbered in the three hundred series.

Figure 8:
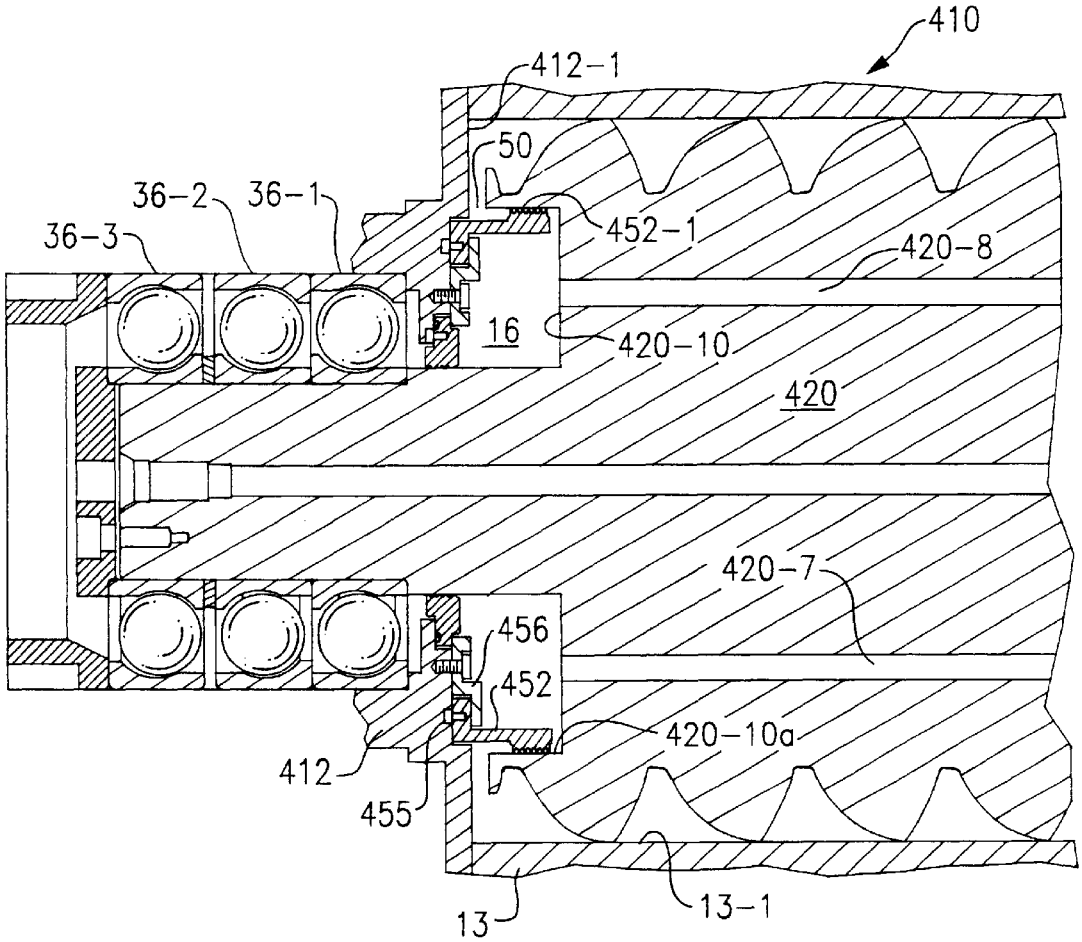
FIG. 8 is a sectional view of a fifth embodiment of the present invention.

The embodiment of FIG. 8 differs from all of the other embodiments in that a circumferential radial seal rather than an axial seal is employed to seal between rotor 420 and casing 412. As in the embodiment of FIGS. 1–3, the seal is a separate member and faces structure on the rotor 420. Specifically, radial seal 452 has an outer circumferential labyrinth seal 452-1 formed thereon. Rotor 420 has an annular recess 420-10 formed on its discharge end. Recess 420-10 defines a portion of annular suction pressure chamber 16 and has an outer surface 420-10*a* which faces labyrinth seal 452-1 and coacts therewith to provide a seal between clearance 50 and annular suction pressure chamber 16. Radial seal 452 is kept from rotating by anti-rotation pins 455 and is held in place by retainer 456 which also engages and axially secures floating radial seal 54 in the same manner as axial seal 52. Otherwise, screw machine 410 is the same in structure and operation as screw machine 10 and only modified structure has been numbered in the four hundred series.

Although preferred embodiments of the present invention have been illustrated and described, other changes will occur to those skilled in the art. For example, the fluid path connecting the suction chamber and the annular suction pressure chamber can be at least partially in the housing structure. It is therefore intended that the scope of the present invention is to be limited only by the scope of the appended claims.

What is claimed is:

1. In a multi-rotor screw machine having a housing, a rotor located in said housing, said rotor having a rotor profile, a rotor profile root diameter, first and seconds ends with said first end exposed to low pressure in said housing, said second end having a running clearance with said housing and being exposed to high pressure radially outward of said rotor profile root diameter, said rotor profile extending between said first and second ends, structure for relieving thrust on said rotor comprising:

a chamber at low pressure located radially inward of said rotor profile root diameter and at least partially formed by said second end; and seal structure coacting with one of said housing and said second end to define a further restriction and thereby a seal between said running clearance and said chamber.

2. The structure for relieving thrust on said rotor of claim 1 further including means for maintaining said chamber at low pressure.

3. The structure for relieving thrust on said rotor of claim 2 wherein said seal structure is annular with a labyrinth seal located thereon.

4. The structure for relieving thrust on said rotor of claim 3 wherein said seal structure is secured to said housing.

5. The structure for relieving thrust on said rotor of claim 3 wherein said seal structure is secured to said rotor.

6. The structure for relieving thrust on said rotor of claim 3 wherein said seal structure is integral with said rotor.

7. The structure for relieving thrust on said rotor of claim 3 wherein said seal structure is integral with said housing.

8. The structure for relieving thrust on said rotor of claim 1 wherein said seal structure is annular with a labyrinth seal located thereon.

9. The structure for relieving thrust on said rotor of claim 8 wherein said seal structure is secured to said housing.

10. The structure for relieving thrust on said rotor of claim 8 wherein said seal structure is secured to said rotor.

11. The structure for relieving thrust on said rotor of claim 8 wherein said seal structure is integral with said rotor.

12. The structure for relieving thrust on said rotor of claim 8 wherein said seal structure is integral with said housing.

13. The structure for relieving thrust on said rotor of claim 1 wherein said seal structure is located on said rotor.

14. The structure for relieving thrust on said rotor of claim 1 wherein said seal structure is located on said housing.

15. The structure for relieving thrust on said rotor of claim 14 wherein said seal structure extends towards said rotor in said clearance.

16. The structure for relieving thrust on said rotor of claim 1 wherein said seal structure extends towards said housing in said clearance.

17. The structure for relieving thrust on said rotor of claim 1 wherein said seal structure is secured to said housing and includes a radial labyrinth seal which seals with a complementary surface on said rotor.

18. In a multi-rotor screw machine having a housing, a suction chamber, a rotor located in said housing, said rotor having a rotor profile root diameter and first and second ends with said first end exposed to low pressure in said housing, said second end having a running clearance with said housing and being exposed to high pressure radially outward of said rotor profile root diameter. structure for relieving thrust on said rotor comprising:

a chamber at low pressure fluidly connected to said suction chamber and located radially inward of said rotor profile root diameter and at least partially formed by said second end; and seal structure coacting with one of said housing and said second end to define a further restriction and thereby a seal between said running clearance and said chamber at low pressure.

19. In a multi-rotor screw machine having a housing, a rotor located in said housing, said rotor having a rotor profile root diameter and first and second ends with said first end exposed to low pressure in said housing, said second end having a running clearance with said housing and being exposed to high pressure radially outward of said rotor profile root diameter, structure for relieving thrust on said rotor comprising:

a chamber at low pressure located radially inward of said rotor profile root diameter and at least partially formed by said second end; and seal structure located radially outward of said chamber and coacting with one of said housing and said second end to define a further restriction and thereby a seal between said running clearance and said chamber.

* * * * *